US005284247A

United States Patent [19]

Turner

[11] Patent Number: 5,284,247

[45] Date of Patent: Feb. 8, 1994

[54] STRUCTURAL UTILITY STRAP CARTON AND DISPENSER

[75] Inventor: Arthur R. Turner, Terranora, Australia

[73] Assignee: SAF-T Corporation, San Diego, Calif.

[21] Appl. No.: 891,665

[22] Filed: May 29, 1992

Related U.S. Application Data

[63] Continuation of Ser. No. 378,883, Jul. 12, 1989, abandoned.

[51] Int. Cl.[5] ..... B65D 85/66

[52] U.S. Cl. ..... 206/395; 206/321; 206/409

[58] Field of Search ..... 206/321, 395, 396, 408, 206/409; 217/66; 52/361, 362, 363; 24/20 R, 20 EE, 23 R

[56] References Cited

U.S. PATENT DOCUMENTS

| | | | |
|---|---|---|---|
| 1,320,220 | 10/1919 | Forbes | 217/66 |
| 1,479,431 | 6/1922 | Gerrard et al. | 24/23 R |
| 1,666,105 | 4/1928 | Mosler | 206/409 |
| 1,816,385 | 7/1931 | Matthaei . | |
| 2,506,354 | 5/1950 | Green | 242/105 |
| 2,595,375 | 5/1952 | Weirich et al. | 206/409 |
| 2,706,592 | 4/1955 | Schaller | 206/395 |
| 2,713,938 | 7/1955 | Snyder | 206/395 |
| 2,796,170 | 6/1957 | Davis | 206/409 |
| 2,844,334 | 7/1958 | Luth | 242/128 |
| 3,115,243 | 12/1963 | Nash | 206/52 |
| 3,149,719 | 9/1964 | Thompson et al. | 206/395 |
| 3,279,590 | 10/1966 | Gould et al. | 206/52 |
| 3,329,259 | 7/1967 | Mayer | 206/396 |
| 3,446,419 | 5/1969 | Mueller | 206/396 |
| 3,602,452 | 8/1971 | Sauer | 242/75.43 |
| 3,680,810 | 8/1972 | Jarmalow | 206/395 |
| 3,810,588 | 5/1974 | Mahoney | 242/552 |
| 3,982,712 | 9/1976 | Bassett | 206/395 |
| 4,239,110 | 12/1980 | Enke et al. | 206/396 |
| 4,396,165 | 8/1983 | Bates et al. | 242/78.1 |
| 4,616,469 | 10/1986 | Skalleberg | 206/395 |
| 4,817,798 | 4/1989 | Huang | 206/408 |

FOREIGN PATENT DOCUMENTS

| | | | |
|---|---|---|---|
| 7991 | 5/1889 | United Kingdom | 217/66 |

*Primary Examiner*—David T. Fidei
*Attorney, Agent, or Firm*—Christie, Parker & Hale

[57] ABSTRACT

A length of galvanized steel structural utility strap, normally 18- to 20-gauge thickness, is shaped in a continuous coil and placed inside a dispensing carton. A length of the utility strap is dispensed from an end wall of the container, from the outer portion of the coil, after which the dispensed strap can be cut off to a desired length. The dispensing carton can contain large centrally located holes on opposite front and rear faces of the carton for use in carrying the carton and the heavy coiled utility strapping material contained within. A measuring gauge located on one or more end walls of the carton is used in measuring preselected lengths of strapping material, which are dispensed and then cut to a preselected length.

18 Claims, 3 Drawing Sheets

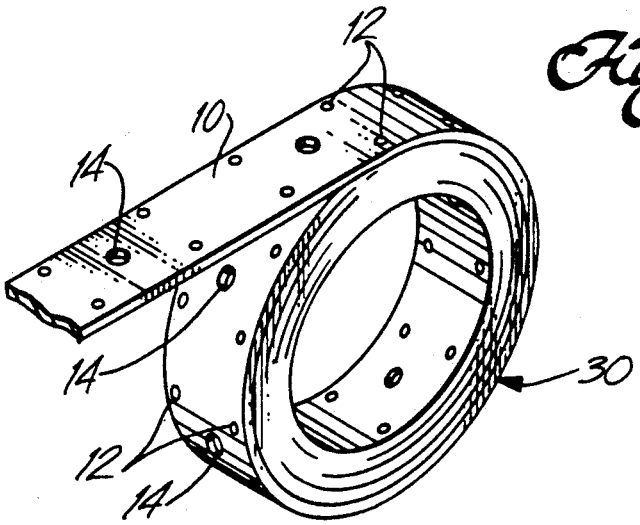
Fig. 4
Fig. 5
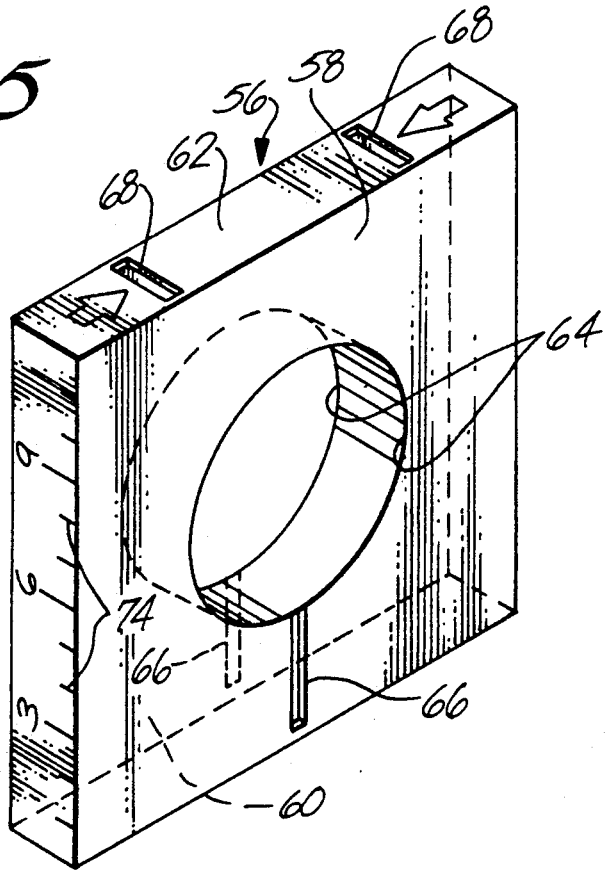

STRUCTURAL UTILITY STRAP CARTON AND DISPENSER

CROSS-REFERENCE TO RELATED APPLICATIONS

This is a continuation of application Ser. No. 07/378,883, filed Jul. 12, 1989, now abandoned.

FIELD OF THE INVENTION

This invention relates to structural building and construction bracing materials, and more particularly to a dispensing carton for use in holding and dispensing a structural utility strap formed as a coil and contained inside the carton.

BACKGROUND OF THE INVENTION

The present invention has to do with a structural utility strap, also referred to as a strap connector or tie connector used as a structural bracing material in the building and construction industry. The utility strap material to which this invention is directed consists of a semirigid elongated sheet metal strap of indeterminate length, commonly made of steel, and generally from 18-gauge (about 0.0478 inch or 1.2 mm) to 20-gauge (about 0.0359 inch or 0.9 mm) thickness.

This utility strap material is typically used as a structural bracing material because of its rigidity and tensile strength (it has good tensile strength, but is lower in tensile strength than nonstructural, much thinner, blue steel strapping material used as a packaging material, for example). The strapping material is much more rigid than the nonstructural packaging material, owing to the dimensions in which the structural utility strapping is commonly available. This material is rigid axially and in torsion and is bendable axially (about an axis perpendicular to the longitudinal axis of the strap) only under a large applied bending force.

A typical use for this structural utility strap material is for joint brace connectors in timber frame construction. Use of these utility straps is required by building codes as a structural connector for floor-to-wall connection, for example. With the use of the metal braces to connect the joints of wall studs, floor joists, double plates, and the like, the building is tied together structurally. Without them, the building would fail structurally.

A typical structural utility strap is commonly one to three inches wide, is galvanized (for corrosion protection), and is prepunched in a set pattern of holes along its entire length. When used, fasteners, such as nails or bolts, can be inserted through the prepunched holes. The strapping material is of sufficiently high strength or rigidity that a nail cannot either be nailed through it, or used to form a pilot hole in it, without the material first being prepunched.

For years, this structural utility strap material has been sold to the building and construction industry in flat, straight, premeasured lengths. Typically, they are available in professional building and construction stores in flat, straight bundles with the individual straps being cut to lengths varying from nine inches to thirty-eight inches, and from nine feet to fourteen feet, thus occupying a substantial amount of shelf or storage space. Transportation, storage and handling of the nine to fourteen foot lengths on a job site is difficult, and the lengths are prone to damage from the construction vehicles used at the site. The shorter precut lengths of nine to thirty-eight inches are scattered around the construction site. As a result, these precut lengths are sometimes not used, the wrong size is often used, and often they are simply wasted.

The present invention avoids the drawbacks of supplying structural utility strap material to the building construction industry in flat, straight, precut lengths. The invention overcomes the cost of shelf or storage space now required for the bundles of utility strap material in building supply stores. The invention is easier to transport to and handle at the building site, and it eliminates the cost of loose straps, wrong sizes, and the associated waste. The invention provides structural utility strap material to any desired length required, where and when it is required, and also eliminates the waste and nuisance of precut straps at building sites.

SUMMARY OF THE INVENTION

Briefly, one embodiment of this invention provides a system for containing and dispensing preselected lengths of a structural utility strap material, comprising a dispensing carton having front and rear walls interconnected by a peripheral end wall for enclosing a hollow interior, and a length of steel structural utility strapping of 18- to 20-gauge thickness in coil form contained within the interior of the dispensing carton. Preselected short lengths of the utility strapping can be dispensed from the coil to the exterior of the dispensing carton for use in cutting off preselected lengths of the utility strapping, as necessary, for structural use.

One embodiment of the invention comprises forming a coil from a long, continuous length of the utility strapping material so that the resulting coil is of a size and weight that can be carried manually and handled by workers, while the length of the coil .is substantially greater than the flat, straight lengths commonly available. The coil is placed inside the carton so that the strapping can be dispensed through a slotted opening in an end wall of the carton, after which the dispensed strapping material can be cut to the desired length. As a result, the years-old practice of supplying structural utility straps in bundles of straight, flat, precut lengths, and the resulting disadvantages, are avoided.

In one form of the invention, the dispensing carton has large, generally centrally located openings formed in the front and rear walls to provide a means for easily carrying the coiled structural utility strap when contained within the carton. A measuring gauge provided on one or more end walls of the carton is a convenient means for measuring lengths of utility strapping removed from the coil so that the strapping may be easily cut to any preselected length.

Because of the rigidity of the structural utility strapping material, owing to its 18- to 20-gauge wall thickness, the material has not been thought of, to our knowledge, as a material which can be coiled into a convenient size for transporting, carrying, handling, and dispensing manually. The utility strapping material must be coiled under pressure applied externally in order to form the material into a coil of reasonable size. However, the material, once wrapped in its coiled form and contained within the dispensing carton, is then reasonably easy to dispense manually from the carton for cutting in any preselected length. One form of the invention comprises placing a length of the unwrapped strapping material on a mandrel which is then rotated while a length of the strapping material is fed to the rotating mandrel and while external pressure is applied to the material to form it as a coil under the applied pressure. After a certain select length of the material is coiled, the resulting coiled material can be removed manually from the mandrel and placed in an open dispensing carton which is then sealed around the coiled material and arranged for subsequent dispensing and cutting.

These and other aspects of the invention will be more fully understood by referring to the following detailed description and the accompanying drawings.

BRIEF DESCRIPTION OF THE DRAWINGS

FIG. 4 is a perspective view illustrating the structural utility strapping wrapped in a coiled form prior to containing it in a dispensing carton.

FIG. 5 is a perspective view illustrating one embodiment of a dispensing carton for containing the coiled utility strapping.

DETAILED DESCRIPTION

Figure 1:
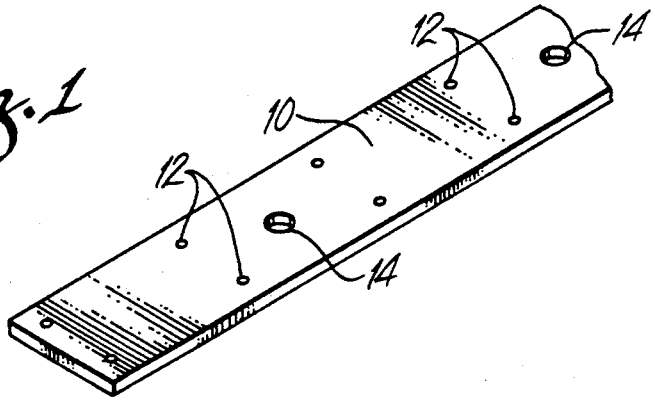
FIG. 1 is a fragmentary perspective view illustrating a length of structural utility strapping which is the subject of this invention.

FIG. 1 illustrates an elongated sheet metal structural utility strap 10 which is the subject of this invention. The structural utility strapping is commonly available in building and construction supply stores in flat, straight, precut lengths, typically in bundles precut to lengths of 12 and 14 inches, although other lengths are available. The structural utility strapping is made of galvanized sheet steel and is commonly one to three inches wide and 16- to 20-gauge in thickness. It has a pattern of prepunched nail holes 12 uniformly spaced apart lengthwise in pairs, and bolt or screw holes 14 also uniformly spaced apart lengthwise at wider spacing than the nail hole pairs. The utility strap material is a galvanized steel strapping, typically meeting standard ASTM-A-446 and a G-90 quality galvanization. The 18- to 20-gauge thickness is a preferred thickness for this type of metal strapping because of its strength and rigidity. Less than 20-gauge thickness is not considered structural. Because of the strength and rigidity of the 18- to 20-gauge material, this strapping is used in the building and construction industry as a structural bracing material. It is a material approved structurally by building departments for building safety. The holes 12 and 14 are prepunched in the strapping material during its manufacturing process. Because of its rigidity, a nail normally cannot be nailed through the strapping material unless it is prepunched.

Figure 2:
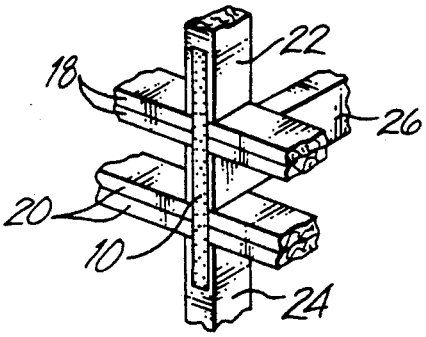
FIG. 2 is a fragmentary perspective view illustrating a typical use of the structural utility strapping material.

FIG. 2 illustrates a typical use of the structural utility strapping 10 as a structural bracing material for timber frame construction. The illustrated framing includes double upper plates 18 spaced apart vertically above horizontal double lower plates 20. An upper wall stud 22 attaches to the top of the double upper plates 18, and a lower wall stud 24 is aligned with the upper wall stud 22 and attached to the bottom plates 20. A floor joist 26 is shown between the pairs of upper and lower plates. A length of the structural utility strapping 10 is cut to the necessary length and nailed over the joints between the upper wall stud 22, the upper plates 18, the end of the floor joist 26, the lower plates 20, and the lower wall stud 24. The strapping provides the necessary structural bracing at these joints to ensure the required rigidity and safety of the entire building. Other uses of the structural utility strapping include positive connectors, subfloor uses, hanging of utilities, floor-to-floor connectors, duct and utility ties, and vent and pipe connectors.

The present invention is based on a recognition of the disadvantages resulting from the age-old use of structural steel utility strapping of 18- to 20-gauge thickness supplied to the building and construction industry in flat, straight, precut lengths. The invention is based on a further recognition that the structural utility strapping can be supplied in much longer lengths which are coiled up and contained within a dispensing carton. Because of its rigidity, the structural utility strapping requires special processing to first shape the material into a coiled form prior to placing it in the dispensing carton. The dispensing carton itself serves as a convenient means for storing, transporting and handling the utility strapping, including cutting off premeasured lengths of the strapping material during use.

Figure 3:
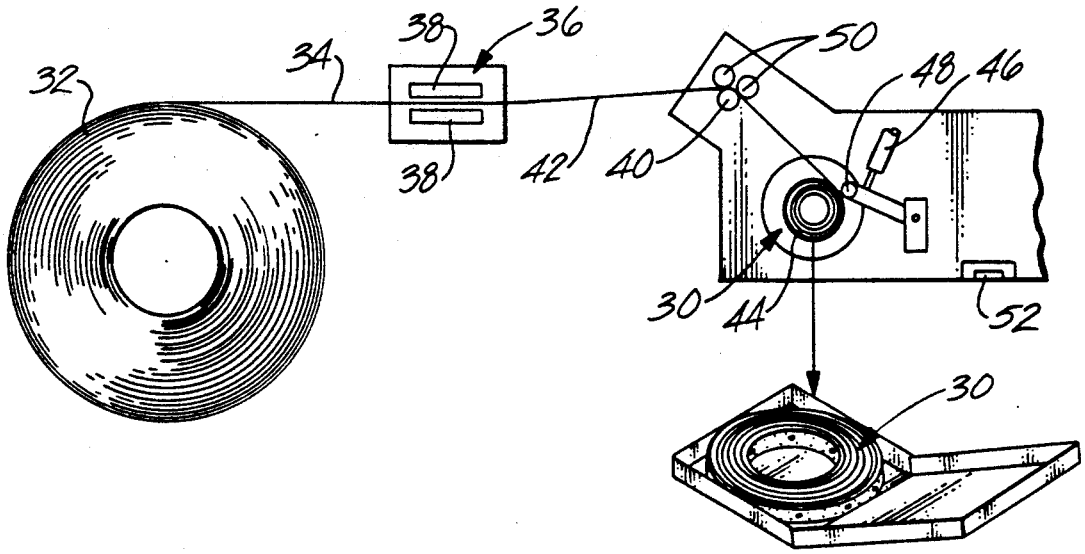
FIG. 3 is a semischematic diagram illustrating a method for shaping the utility strapping material into a coiled form for containing in a dispensing carton.

FIG. 3 schematically illustrates a preferred technique for preforming the structural utility strap material 10 into a coil 30 shown in FIG. 4. The strapping material 10 is supplied from the manufacturer in large coils, one of which is illustrated at 32 in FIG. 3. As an example, these large coils can be three to four feet in outside diameter, with a center hole approximately one to 1½ feet in diameter. The large coil 32 weighs several hundred pounds. The large coil is mounted so that the strapping 34 can be drawn from the outside of the coil through a punch press 36 where dies 38 prepunch the holes 12 and 14 in the strapping material. A roller 40 pulls the prepunched strap 42 away from the punch press to a mandrel 44, which rotates to form a coil of the prepunched strapping material. A pneumatic arm 46 and a roller 48 apply a large amount of pressure to the outside of the coiled material. A measuring and cutoff mechanism 50 constantly measures the length of material being coiled and cuts off the strapping in coiled lengths of preferably 100 feet. After the coiled material is cut off in the desired length, a tape or other binding material is wrapped around the coil to hold it in place, after which a foot pedal 52 is used to eject the finished coil 30 from the mandrel. The coil 30 is then placed in an open dispenser carton 54, which is then wrapped around the finished product and glued so that the product is contained within the interior of the finished carton.

FIG. 4 illustrates the coiled form of the strapping material ready for being placed in the dispensing carton. In this form, the coiled strapping material has an outside diameter of about one foot, the large hole inside the coil has a diameter of about eight inches, and the thickness of the coiled material on each side of the large central hole is about two inches in width. The resulting coil weight ranges from approximately 15 to 25 pounds. The strapping material is coiled in a continuous length that produces a coil of a size and weight that can be carried manually and handled easily at the building site by workers using the material as a structural strap. A length substantially greater than one-story height, e.g., 12 to 14 feet is used. The desired length is in the range of about 50 to about 120 feet, with 100 feet in length being most preferred.

Figure 6:
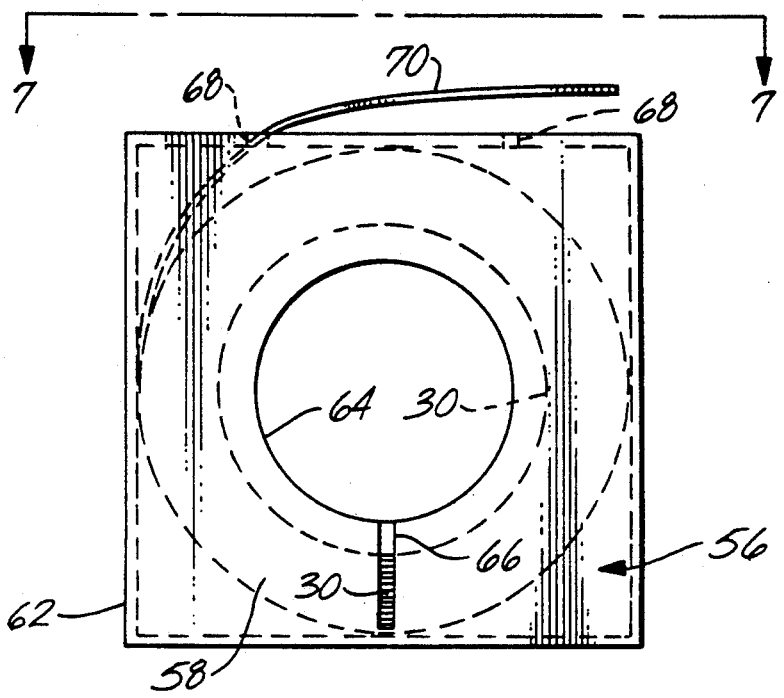
FIG. 6 is a front elevation view illustrating the dispensing carton containing the coiled utility strapping.
Figure 7:
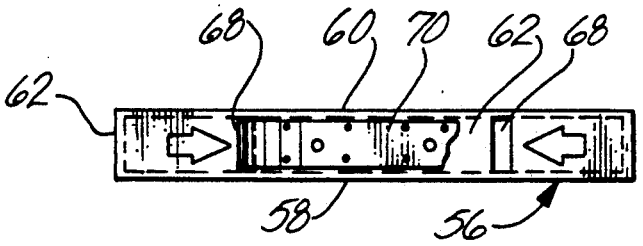
FIG. 7 is a top plan view taken on line 7—7 of FIG. 6.

FIG. 5 illustrates the form of a preferred dispensing carton 56 in its finished form. (The coiled strapping material not shown on the inside of the carton for clarity.) FIGS. 6 and 7 illustrate the coil 30 of strapping material contained within the carton. The carton is preferably made of a strong, light weight material of sufficient strength to hold the coil 30 under its own weight, and a preferred carton material is a structural cardboard. The dispenser is generally of rectangular shape, preferably about one-foot square, and has a rectangular front panel 58 and a rectangular rear panel 60, both of which are interconnected by a rectangular peripheral end wall 62. A large centrally located hole 64 extends through both the front and rear panels. These holes are aligned on a common axis and provide a means for manually gripping and carrying the dispensing carton during use. A narrow slot 66 extends downwardly below each central opening 64 to provide a means for visually determining the amount of coiled material left in the dispensing container. A pair of spaced apart slotting openings 68 are formed in the top end wall of the dispensing container. As illustrated best in FIGS. 6 and 7, an end length of strapping material 70 is fed from the outside of the coil in the carton through either one of the slotted openings 68 to facilitate withdrawing selected lengths from the coil to the outside of the dispensing carton. The end walls at each side of the dispensing carton can have a measuring gauge with inch markings 74 to provide a means for measuring each length of strapping dispensed from the container to facilitate cutting off selected lengths of material.

In use, the coiled structural utility strapping contained in the dispensing carton is easy to handle during transport from the manufacturer to the building and construction supply store and from the supplier to the building site. Substantial time and labor are saved at the building site because the worker can easily handle the material and also quickly cut off desired lengths from the material dispensed from the container. The invention also saves material costs because waste material is greatly reduced, and the invention avoids the disadvantages of having scrap material strewn about the building site.

What is claimed is:

1. For use in containing and dispensing preselected lengths of a structural building material at a building site, the combination comprising:

a dispensing carton having front and rear walls interconnected by a peripheral end wall for enclosing a hollow interior;

a continuous length of steel structural utility strapping of 16- to 20-gauge thickness wound in the form of a coil and contained within the hollow interior of the dispensing carton; and means for dispensing a preselected lengthwise portion of the utility strapping from the coil to the exterior of the dispensing carton for use in cutting off a preselected length of the utility strapping.

2. Apparatus according to claim in which the structural utility strapping has a pattern of prepunched holes extending along the length of the strapping.

3. Apparatus according to claim 1 in which the strapping is made of galvanized steel.

4. Apparatus according to claim 3 in which the strapping is at least about one-inch wide.

5. Apparatus according to claim 1 in which means for dispensing the strapping comprises a slot through the peripheral end wall of the container arranged for receiving an outermost portion of the strapping dispensed from the coil.

6. Apparatus according to claim 1 including at least one generally centrally located large hole in at least the front or rear wall of the carton for use in carrying the carton.

7. Apparatus according to claim 6 including a narrow slot extending away from the central opening for use in visually determining the amount of coiled material left inside the carton.

8. Apparatus according to claim 1 including a measuring gauge on a peripheral end wall of the carton for use in measuring the length of dispensed strapping material.

9. For use in containing and dispensing preselected lengths of a structural building material at a building site, the combination comprising:

a dispensing carton having front and rear walls interconnected by a peripheral end wall for enclosing a hollow interior;

a continuous length of galvanized steel structural utility strapping prepunched with a pattern of fastener holes extending along the length of the strapping, the structural utility strapping having a thickness of 16- to 20-gauge for use in providing structural bracing for timber frame construction wherein said steel structural utility strapping is wound in the shape of a coil contained within the hollow interior of the dispensing carton; and means for dispensing a preselected length of the utility strapping from a portion of the coil to the exterior of the dispensing carton for use in cutting off a preselected length of the utility strapping.

10. Apparatus according to claim 9 in which the strapping is at least about one-inch wide.

11. Apparatus according to claim 9 including a measuring gauge on a peripheral end wall of the carton for use in measuring the length of dispensed strapping material.

12. For use in containing and dispensing preselected lengths of a structural building material at a building site, the combination comprising:

a dispensing carton having front and rear walls interconnected by a peripheral end wall for enclosing a hollow interior;

a continuous length of steel structural utility strapping of the type meeting standard ASTM-A-446 with a thickness in the range from 16-to 20-gauge wound in the form of a coil and contained within the hollow interior of the dispensing carton; and means for dispensing a preselected lengthwise portion of the utility strapping from the coil to the exterior of the dispensing carton for use in cutting off a preselected length of the utility strapping.

13. Apparatus according to claim 12 in which the structural utility strapping has a pattern of prepunched fastener holes extending along the length of the strapping.

14. Apparatus according to claim 13 in which the utility strapping is made of galvanized steel.

15. Apparatus according to claim 14 in which the strapping has a width in the range of about one to about three inches.

16. Apparatus according to claim 1 in which the utility strapping has a thickness in the range of 18- to 20-gauge.

17. Apparatus according to claim 9 in which the utility strapping has a thickness in the range of 18- to 20-gauge.

18. Apparatus according to claim 12 in which the utility strapping has a thickness in the range of 18- to 20-gauge.

* * * * *

UNITED STATES PATENT AND TRADEMARK OFFICE

CERTIFICATE OF CORRECTION

PATENT NO. : 5,284,247

DATED : February 8, 1994

INVENTOR(S) : Arthur R. Turner

It is certified that error appears in the above-indentified patent and that said Letters Patent is hereby corrected as shown below:

Column 5, line 59, after "claim" insert -- 1 --.

Column 5, line 66, before "means" insert -- the --.

Signed and Sealed this

Eighteenth Day of April, 1995

Bruce Lehman

*Attest:*

BRUCE LEHMAN

*Commissioner of Patents and Trademarks*

*Attesting Officer*